US010624508B2

(12) United States Patent
Duarte

(10) Patent No.: US 10,624,508 B2
(45) Date of Patent: Apr. 21, 2020

(54) VARIABLE HEIGHT LIFT SEAT

(71) Applicant: Raul Duarte, Belleville, IL (US)

(72) Inventor: Raul Duarte, Belleville, IL (US)

( * ) Notice: Subject to any disclaimer, the term of this patent is extended or adjusted under 35 U.S.C. 154(b) by 0 days.

(21) Appl. No.: 15/607,642

(22) Filed: May 29, 2017

(65) Prior Publication Data

US 2017/0347845 A1 Dec. 7, 2017

Related U.S. Application Data

(60) Provisional application No. 62/345,642, filed on Jun. 3, 2016.

(51) Int. Cl.

| | |
|---|---|
| ***A47K 13/28*** | (2006.01) |
| *A47K 13/06* | (2006.01) |
| *A47K 17/02* | (2006.01) |
| *A47K 13/30* | (2006.01) |
| *E03D 9/08* | (2006.01) |

(52) U.S. Cl.

CPC ..... *A47K 13/28* (2013.01); *A47K 13/06* (2013.01); *A47K 13/302* (2013.01); *A47K 17/02* (2013.01); *E03D 9/08* (2013.01)

(58) Field of Classification Search

USPC ..... 4/667

See application file for complete search history.

(56) References Cited

U.S. PATENT DOCUMENTS

| | | | | |
|---|---|---|---|---|
| 4,185,335 A | | 1/1980 | Alvis | |
| 4,581,778 A | | 4/1986 | Pontoppidan | |
| 4,833,736 A | | 5/1989 | Sadler et al. | |
| 4,993,085 A | | 2/1991 | Gibbons | |
| 5,063,617 A | * | 11/1991 | Ward | A61G 7/1007 297/DIG. 10 |
| 5,142,709 A | | 9/1992 | McGuire | |
| 5,561,872 A | | 10/1996 | Phillips | |
| 5,592,703 A | | 1/1997 | Jones et al. | |
| 6,154,896 A | | 12/2000 | Houston et al. | |
| 6,161,229 A | | 12/2000 | Ryan et al. | |
| 6,360,382 B1 | | 3/2002 | Karash | |
| 6,553,585 B1 | * | 4/2003 | Lundstrom | A61G 7/1007 4/667 |
| 6,754,917 B1 | * | 6/2004 | Rhoades | A61G 7/1007 4/667 |

OTHER PUBLICATIONS

U.S. Medical Supplies, e-Catalog page, 2016.
First Street e-Catalog Quick Order page, 2016.
Accessible Construction, Inc. On-line catalog, Power Toilet Aid—Toilet Seat Lift, May 30, 2016, www.accessibleconstruction.com/services/bathrooms/power-toilet-aid.
Lift Seat Powered toilet lifts, web pages, Jun. 5, 2015, www.liftseat4home.com/liftseat-product-specifications.
SpinLift Experts in Motion Toilet Lift web pages, www.spinlife.com/LiftSeat-Toilet-Safety-Frame/spec.cfm May 30, 2016.
Intelligent Toilet Instruction Manual by Ningbo JT Intelligent Sanitaryware Col, Ltd.

* cited by examiner

*Primary Examiner* — Lauren A Crane
(74) *Attorney, Agent, or Firm* — Rebecca J. Brandau

(57) ABSTRACT

A variable height lift seat assembly includes a framework providing a seat mounting site. A plurality of linear actuators operably connects to the framework and each linear actuator has a power supply and preselected set points. A control mechanism operably connects to the linear actuators for controlling up and down and angular movement of the seat mounting site of the frame.

28 Claims, 11 Drawing Sheets

GAS SPRING 20 LBS. FORCE

VARIABLE HEIGHT LIFT SEAT

CROSS-REFERENCE TO RELATED APPLICATION

This application relies upon and claims the benefit of the filing date of U.S. Provisional Patent Application, Ser. No. 62/345,642, filed Jun. 3, 2016 the entirety of which is incorporated herein by reference.

FIELD OF THE INVENTION

The present invention relates generally to mechanized seats, and in particular, to a toilet seat especially designed for the handicapped, elderly, or others with significant physical limitations, which seat has selectively variable heights and modes of operation to lift the user, and which optionally includes an incorporated bidet.

BACKGROUND AND SUMMARY OF THE INVENTION

Mechanized seats, such as some types of lift chairs have been known. Such items usually include some mechanical means, either manual or motorized, to cause the seat portion to be capable of tilting forwardly from a base position to permit a person with limited strength, or joint mobility, for example, to gradually attain an upright posture from a sitting position by effectively pushing them forwardly. Initially, these devices were limited to living room-type chairs. Eventually modifications were made such that certain such lift devices could be connected in one way or another to a standard toilet seat, or, in some cases, completely replace the toilet seat. A variety of such apparatuses have previously been developed, with various limitations or deficits.

The present invention was initially conceived for use by an adult male having ALS (amyotrophic lateral sclerosis). Persons with ALS or other significant physical handicaps may have difficulties using the toilet, as well as cleaning themselves afterwards; the present toilet seat lift was designed and built for individuals having such various physical disabilities or infirmities, in order to assist them with the ability to attend to their toilet functions, either alone, or with limited assistance.

As an example, the loss of muscle function caused by ALS creates the need for significant assistance in order for the patient to get on and off the toilet. Such a person may not be able to walk to the toilet, turn and become seated, or even to readily maintain the sitting position. Modifications to a conventional or bidet toilet seat have been developed, as described below, to address such additional needs, resulting in an apparatus with numerous advantageous features that can be offered in various combinations, as desired or needed by a given individual or a particular household or facility, such as a nursing home or hospital. Because some homes or healthcare facilities have more than one potential user, with different body sizes and abilities, the new variable height lift seat has been developed so as to be suitable for being offered with a number of selectable functional options and features. A site of use with multiple individuals of various needs might prefer a model with the largest range of use and features, whereas a small home with only one user might prefer a simpler configuration with a design more specific to that single user's body type and needs.

Accordingly, for simplicity throughout this discussion and description, two of the different possible modes of use will be referred to as the High Mode and the Low Mode. These titles mean, as follows: the High Mode is best suited for use by a relatively taller person; and the Low Mode use best suited for use by a relatively shorter person. These modes of use will be explained further hereafter in conjunction with the Detailed Description of the Invention.

An additional issue for some physically handicapped persons who may have difficulties using the toilet is that they may also be impaired to the extent that they have difficulty cleaning themselves afterwards. This might ordinarily require additional help from an assistant for this highly personal task. Accordingly, the bidet version of the new variable height seat lift was designed and built for individuals having such disabilities or infirmities, which may cause difficulties in cleaning themselves after using the toilet, such as can occur with, for example, ALS, extreme obesity, and/or joint problems. It is to be understood that throughout this document the bidet seat version can be used for either the High Mode or the Low Mode of the new toilet seat lift.

It should be also understood that the overall lift assembly described herein could foreseeably also be used in combination with some other type of sitting surface, other than a toilet seat. For purposes of simplicity, in the description and the claims below, the new variable height lift seat will be described in combination with a toilet seat, of either a conventional or bidet variety. Thus, it is to be understood that when reference is made to a toilet seat or a bidet seat, that some other sitting surface could be substituted therefor and such combination will still fall within the parameters of the following description and claims and be deemed as within the present invention.

SUMMARY OF THE INVENTION

The new seat lift described and claimed herein can be made so as to permit comfortable, safe use by different people having a wide range of heights and other physical characteristics, and so that it can be provided with an optional bidet seat for the user's convenience and privacy.

Thus, the new variable height lift seat is, briefly a framework providing a seat mounting site. A plurality of linear actuators operably connects to the framework and each linear actuator has a power supply and preselected set points. A control mechanism operably connects to the linear actuators for controlling up and down and angular movement of the seat mounting site of the frame.

The invention is also, briefly, the combination of a seat and variable height lift seat assembly having a framework with a front and a back. The framework provides a mounting site for the seat. A plurality of linear actuators operably connects to the framework and each of the linear actuators has a power supply and preselected set points. A control mechanism operably connects to the linear actuators for controlling up and down and angular movement of the seat mounting site and the seat mounted on the framework.

The invention is further, briefly, a variable height lift bidet seat assembly including a framework, a plurality of linear lift actuators connected to the framework and vertically movably disposed within the framework. A bidet seat of the assembly is forwardly, tiltably mounted on the framework. A control mechanism is connected to the linear lift actuators and has controls to permit a user of the seat to selectively move the seat vertically up and down and to selectively tilt the seat forwardly at a rate and to a degree sufficient to facilitate movement of the user off of the lift bidet seat and to a standing position without significant risk of causing the user to slide or fall forwardly off of the bidet seat.

The invention still further is a variable height lift seat assembly including gas springs connected to the framework of any of the above assemblies, to absorb shock and thereby enhance stability of the lift seat assembly for safety and comfort of a user thereof.

Further benefits and features of the invention will be made clear with reference to the several figures attached hereto and in the Detailed Description below.

BRIEF DESCRIPTION OF THE DRAWINGS

The attached drawings, FIGS. 1 through 10, illustrate the advantages and features of the invention and its safe operation; wherein:

FIG. 1 is side elevational view of the mechanized lift seat of the present invention, with bidet style seat incorporated, shown in a normal use position, for sitting on a toilet.

FIG. 2 is a side elevational view of the seat of FIG. 1, shown in a tilted, partially elevated position for a relatively shorter person to dismount the seat (Low Mode).

FIG. 3 is a top plan view of the lift seat of FIG. 1;

FIG. 4 is a right side view of the seat of FIG. 1, showing the arm rests and controls in exploded view, above the level of the seat.

FIG. 5 is a right side elevational view of the seat of FIG. 1, shown in a raised position for use by a relatively taller person (High Mode), in the position for assisting the user in standing from the seat.

FIG. 6 is an electrical wiring schematic associated with the operation of the seat of FIG. 1.

FIG. 7 is a side elevational view of the seat of FIG. 1, showing a useful configuration for water installation for the optional bidet portion of the seat.

FIG. 8 is a partial rear elevational view of the seat of FIG. 1 showing a gas spring stabilizer mechanism.

FIG. 9 is an enlarged view of one of the gas springs shown in FIG. 8.

FIG. 10 is a side elevational view of the framework of the present invention, illustrating with exaggeration by arrows: the pivotal connection provided at the lower and upper ends of the rear actuators allows the rear actuators to shift slightly to permit the forward inclination of the seat on the pivoting upper frame as shown in FIG. 7, as compared to the seat position in FIG. 1.

Throughout the figures like numbers are used to indicate like elements of the invention. Some elements are omitted from some of the figures for clarity and simplicity of the drawings.

DETAILED DESCRIPTION OF PRACTICAL EMBODIMENTS

Figure 1:
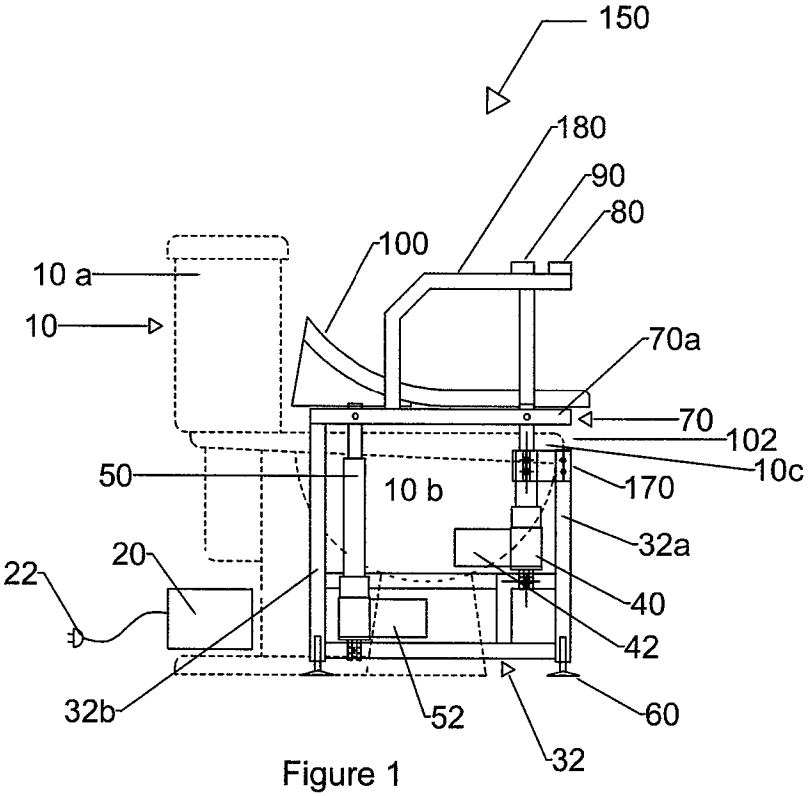

With reference to the attached drawings, FIG. 1 illustrates the new mechanized lift seat, generally designated 150, in the normal use position, whereby the user, who may be a handicapped or elderly person, can sit on a toilet seat 100 to perform their physiological activities (toilet duties). In the position shown, the seat 100, which may have an optional bidet incorporated, is shown attached to a conventional toilet 10 commonly found in a private home, or institutional environment. Toilet 10 is shown, in broken lines, with a conventional toilet tank 10*a* and bowl 10*b*. Nonetheless, the toilet 10 style used with the new lift assembly 150 (described below) may be of essentially any different style, such as a toilet attached to the wall for water supply, without a visible tank, and/or the bowl 10*b* may vary in general size and shape while still being suitable for use with the disclosed assembly 150. It should be understood that throughout this document the terms "front" and "back" or "rear" refer to the same directions as if referring to a person using the device. That is, a person seated on the device in normal use position faces front (forwardly) and the toilet tank then is back behind that person; i.e. rearward of the user.

Figure 2:
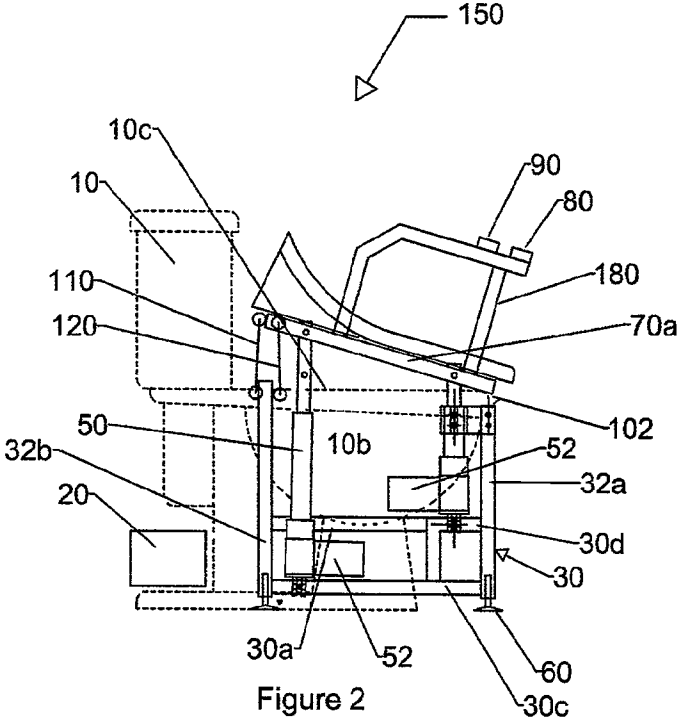

FIG. 2 illustrates the Low Mode operation position of the mechanized lift seat 150 with an optional bidet incorporated for the handicapped or elderly is attached to a conventional toilet 10, such as is commonly found in a private home or institutional environment. When the physiological activities (toilet duties) are done, the user of assembly 150 can turn off the front linear actuators 40 via the switch 80 and then depress the UP button of the controller 90. In the configuration preferred, when the UP button is depressed and held down, the back of the bidet seat rises and thereby assists the user in getting off the seat 100. FIG. 2 also shows the elevated position of the back of the bidet seat 100 in the dismount position.

Seat lift assembly 150, in its most basic form, includes a lower frame, generally designated 30, four upright supports and a tiltable upper frame, generally designated 70. Lower frame 30 includes a rigid, preferably generally rectangular, or U-shaped base portion, generally designated 32. Lower frame 30 is of sufficient dimensions sized to fit below toilet bowl 10*b* and around the toilet base, with the frame base 32 substantially parallel to the floor when the new assembly 150 is in normal operative position. As shown, base portion 32 has three sides and an open back end to permit lower frame 30 to be set in toward a rear wall of the toilet facility, so that it substantially surrounds the toilet on three sides. Ordinarily, it is expected that the overall width of lift seat assembly 150 will not exceed about 28 inches, for use with a normal size toilet. Nonetheless, it is foreseeable that there may be rare instances in which a custom size may be necessary, and such can be accommodated by adjusting the dimensions of assembly 150.

At each of the four corners of lower frame base portion 32 there is securely connected an upwardly extending corner post or rigid support, indicated as 32*a* in the front, and 32*b* in the rear, of lift seat assembly 150. At the lower-most end of each support 32*a*, 32*b* there is preferably mounted an adjustable foot 60 of known configuration, to facilitate leveling of the entire assembly 150 on the floor or other support surface, as may be deemed necessary in some installation sites. Alternative, although sometimes less desirable, configurations of lift seat assembly 150, can be provided wherein frame legs 32*a*, 32*b* are footless or simply provided with pads or footed ends that are not adjustable.

Like lower frame 30, upper frame 70 is preferably a rigid rectangle, of similar dimensions. Upper frame 70 serves as a support site upon which to mount the regular toilet seat or bidet-style seat 100, directly above toilet bowl 10*b*. As shown in FIG. 2, upper frame 70 is different, however, in that is movable, both vertically, i.e. flat, up and down, relative to a horizontal plane, as well as tiltably, i.e. at an angle relative to the horizontal plane. This is accomplished, as is described in detail below, by use of paired linear actuators 40, 50 which extend substantially vertically between the base, lower frame 30 and the seat support, upper frame 70.

Lower frame 30 is preferably, but not necessarily, made of one inch square metal tubing and incorporates the mounting of the lower portion of the front linear actuators 40 and the back linear actuators 50. Supports 32 are not connected at upper ends thereof to the upper frame 70, but terminate beneath the horizontal plane in which frame 70 lies when in the fully down position. As such, when the toilet seat 100 is in a lowered position, lower frame 30 and upper frame 70, along with vertical supports 32 form an open, box-shaped housing or cage around the toilet base and bowl and the four linear actuators 40, 50 the left and right sides thereof being essentially the same. For simplicity of the drawings, only the left side view is shown. On the user's left side (not seen) of the housing the two left vertical supports 32 are preferably joined midway by a cross bar 30*a* which provides structural strength and stability to the housing. A similar bar 30*a* is likewise positioned on the right side of lower frame 30, but is omitted from the figures, so as to not block the view of the actuators. At the lower front of the housing, lower frame 30 has a transverse rigid bar 30*b*, indicated by a phantom line in FIG. 3, which bar is directly below and hidden from view by upper frame transverse (front) bar 70*b*. Front transverse bar 30*b* is connected at opposed ends thereof to front ends of lateral rigid bars 30*c*, such as to form a U-shaped base on lower frame 30.

Upper frame 70 is similarly generally rectangular and preferably made of rigid, one inch square metal tubing. Frame 70 provides a site for pivotal mounting of the upper portion of front linear actuators 40 and back linear actuators 50. Upper frame 70 pivotally connects by known mechanisms to the upper ends of the movable shafts of linear actuators 40, 50, as seen in FIG. 2, wherein the telescoping upper ends of front actuators 40 connect substantially adjacent to the upper ends of upright supports 32*a* and the telescoping upper ends of actuators 50 attach substantially adjacent to the rear ends of lateral side bars 70*a*. The lower ends of the rear linear actuators 50 are fully pivotal, as indicated by the arrow Yin FIG. 10, the lower ends of front linear activators 40 are firmly and non-pivotally secured to lower lateral rails 30*c*. The frame connections at the upper ends of both front linear actuators 40, and rear linear actuators 50 are pivotal to allow movement (tilting) of upper frame 70 as indicated with arrows labeled with the letters X in FIG. 10. Letter Z indicates the angle of movement available in the position of the upper ends of rear actuators 50 to accommodate the tilting of the upper frame. This feature is necessary to prevent unnecessary stress on the connection points of the actuators to the upper frame. Firmly secured to lower frame 30 adjacent the lower end of each of rear actuators are electric motors 42, 52 which drive the actuators up and down upon receiving the appropriate signals from the hand controllers 80, 90. It is preferred, although not required, that a known battery backup (not seen) be included in the power assembly.

Front actuators 40, however, are shorter than rear actuators 50 and therefor are mounted near the front, but higher than the level of the lateral horizontal rail 30*c*. A rigid angle 30*d* of frame material is preferably fixed at the inside intersection of the corresponding left and right lower ends of each front leg 32*a* and front ends of lateral bars 30*c*. This angle element 30*d* can be seen in several figures, all showing right side elevational views of the lower frame 30. It should be understood that a left side elevational view of all frame elements will be simply reverse images of the views seen and described herein. Frame angle portions 30*d* extend upwardly, within the plane formed between the front and rear upright supports on a corresponding side of lower frame 30, and then horizontally forwardly, by a distance of several inches in each direction, to rigidly connect to upright supports 32*a*, so as to provide strong, secure sites for support and connection of the lower ends of corresponding front actuators 40. As with the rear actuators 50, the lower ends of the front linear actuators do not pivot, but are firmly secured to lower frame 30 in order provide stability to seat lift assembly 150 as the seat 100 is lifted, lowered and/or tilted.

Figure 3:
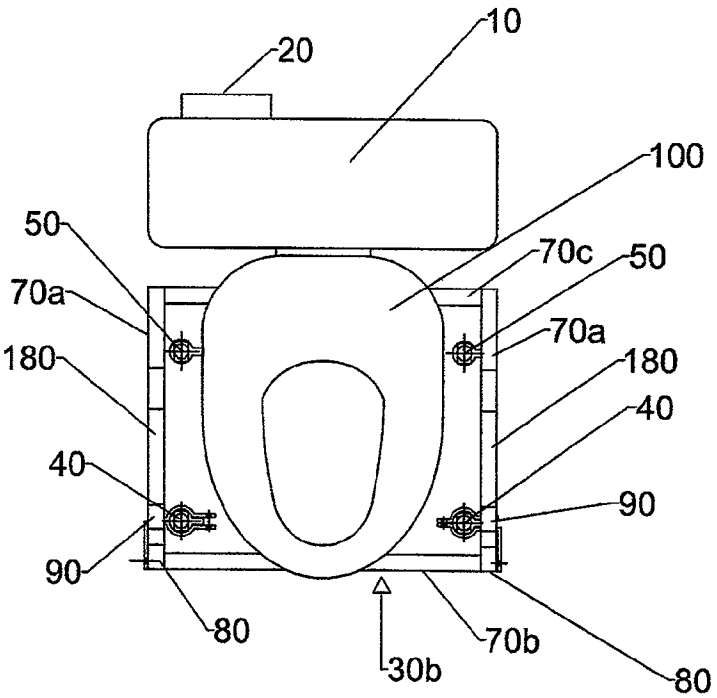

FIG. 3 provides a top plan view of the new variable height lift seat 150, whereby it can be seen that the upper ends of the paired linear actuators 40, 50 are disposed just to the inside of the lateral bars 70*a* of top frame 70. It is necessary that the lower ends of front linear actuators 40 be very strongly secured at their respective bases, to keep the actuators fixed in the vertical position. The movable shaft of actuator 40 is attached adjacent the front end of lateral rail 70*a* in a manner that allows the rail to pivot, relative to the vertical line of the actuator shaft, so that extension or contraction of the back linear actuators 50 causes change in the angle of tilt of the upper frame 70. Front linear actuators 40 are also secured at the upwardly directed housing thereof to the nearest rigid upward support 32*a* via corresponding brackets 170 (shown in FIGS. 1 and 4), to lend further stability to the lift seat assembly 150. While other suitable mechanisms for securing the actuators to the upper and lower frames may be conceived, the arrangement shown and described is preferred.

Figure 4:
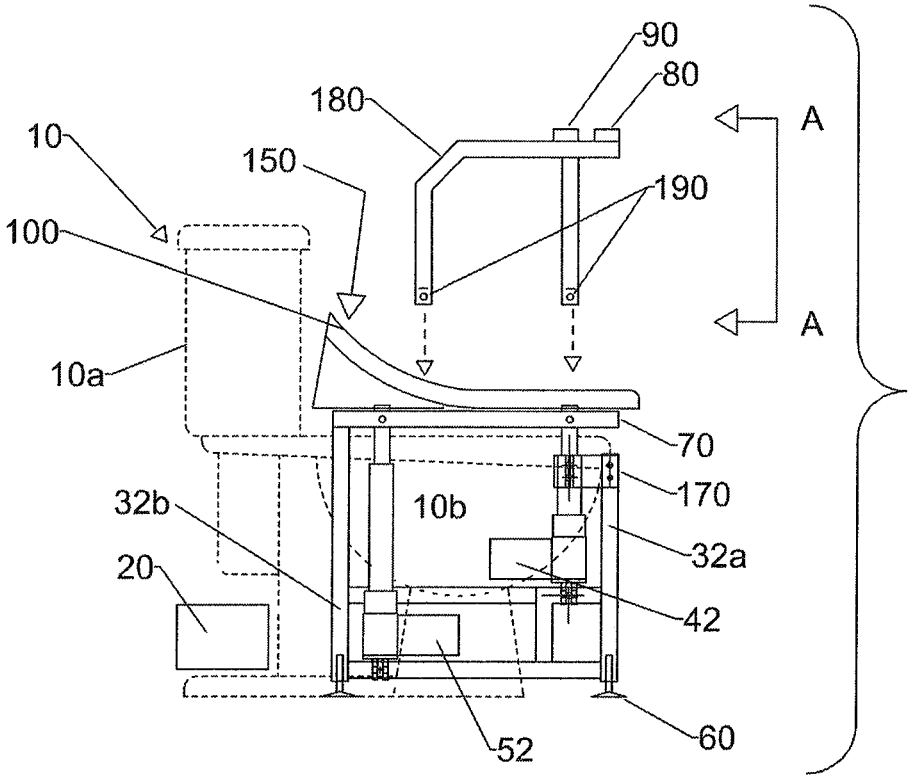
Figure 4A:
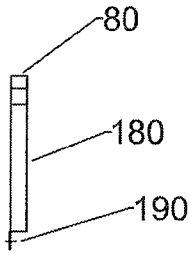
FIG. 4A illustrates a front sectional view of an arm rest, taken on section A-A of FIG. 4.

As seen in FIGS. 4 and 4A, upper frame 70 also preferably incorporates arm supports 180. Arm rests 180 are also preferably made of one inch square metal tubing, welded to or otherwise strongly secured to the paired lateral side bars 70*a* of upper frame. It is foreseeable that some other suitably strong material may be useful in manufacture of the frame and arm supports, and that the shape of the bars could be round, or otherwise, as long as it is strong enough to safely bear the weight of the user and can be safely secured to upper frame 70. One of the arm supports 180 can incorporate the On/Off switch 80 which permits the user or an assistant to disable front linear actuators 40 and Lift/Tilt controls indicated at 90.

In the preferred embodiments of lift seat assembly 150, arm rests, such as are indicated at 180, for example, are secured to upper frame 70 by mounting on rigid side pieces 70*a* in a suitably secure, preselected manner. An example of such an arm rest 180 connected to assembly 150 is seen in several of the attached illustrations. Arm rests 180 can be rigidly, permanently fixed to the frame, as by welding to the side pieces 70*a*, for example. An alternative construction for arm rest 180 is illustrated in FIG. 4, wherein the arm rest 180 is shown in an exploded view, FIG. 4A providing a front elevational view of the arm rest only. Element number 190 indicates holes defined on tabs which permit connection of arm rest 180 to upper frame 70. The side pieces 70*a* of upper frame 70 may be provided with connection sites, such as screw holes and bolts or other suitable means, as a place to removably, but firmly, and securely affix the arm rests 180. Arm rests 180 can be provided on either left or right side of the upper frame, or on both sides, depending upon the installation site and the needs and preferences of the prospective user of variable height lift seat assembly 150.

An enclosure or "J box" 20 contains an uninterrupted power supply (UPS 130 FIG. 6), such as that available commercially, for example, under the name, NEMA 4X, which UPS powers operation of linear actuators to lift or tilt seat 100, as required by the mechanized lift seat 150 with or without a bidet incorporated. The power cord 20*a* of the power supply 20 is connected to a conventional ground fault interrupter protected 120 VAC electrical receptacle (not shown). Other suitable electrical cords can extend from the enclosed UPS to the controls 80, 90 and from the controls to the four linear actuators, as illustrated more completely in FIGS. 6 and 7. The power cord (not shown) for the bidet/toilet seat 100 is connected to the same UPS.

Figure 5:
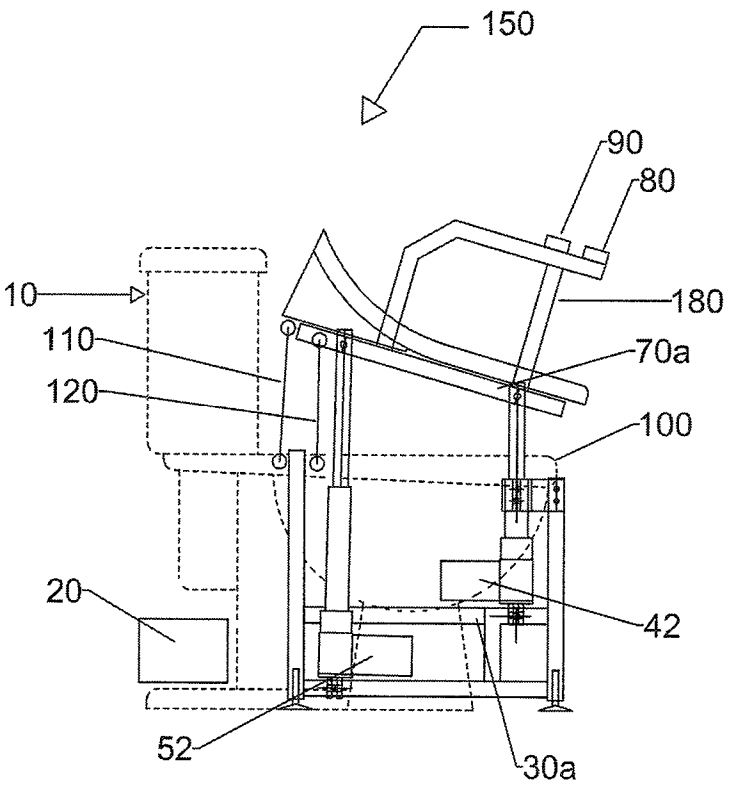

FIG. 5 clearly shows the elevated positions of front and back of the bidet seat 100. In the back of the frame there are two gas springs, indicated schematically at 110, 120, as mounted in an X form relative to each other in order to operate against each other to stabilize the entire assembly when it is in the up position, and the back linear actuators 50 are fully extended. Springs 110, 120 are seen more clearly in the back plan view of FIG. 8.

Figure 6:
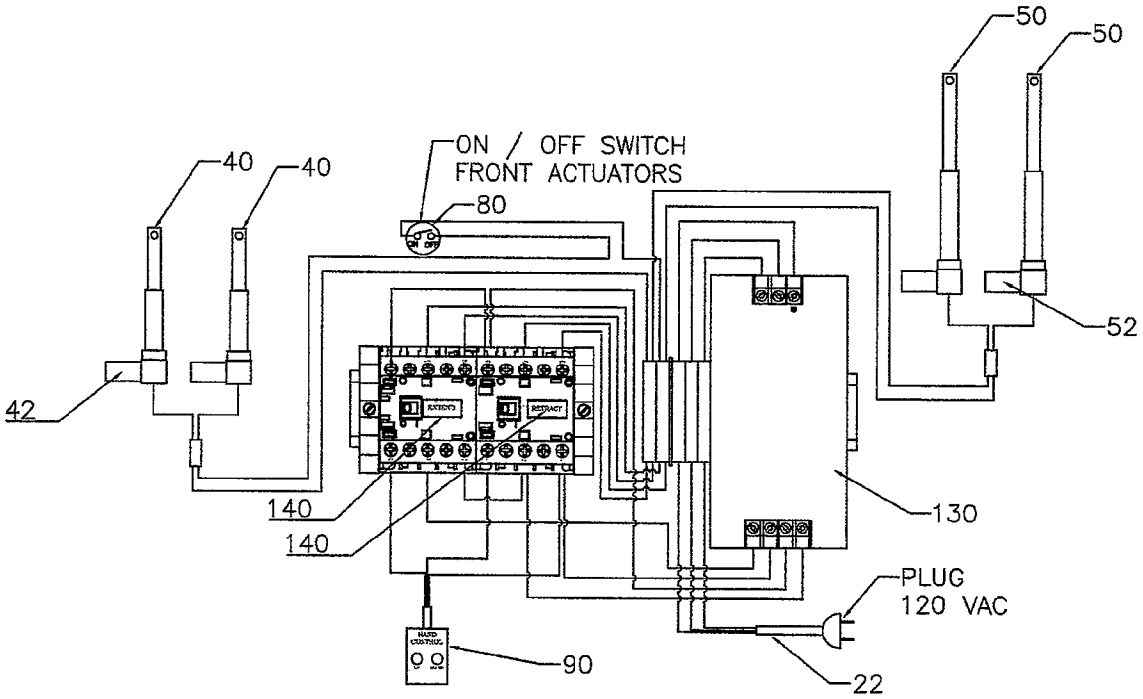
Figure 6A:
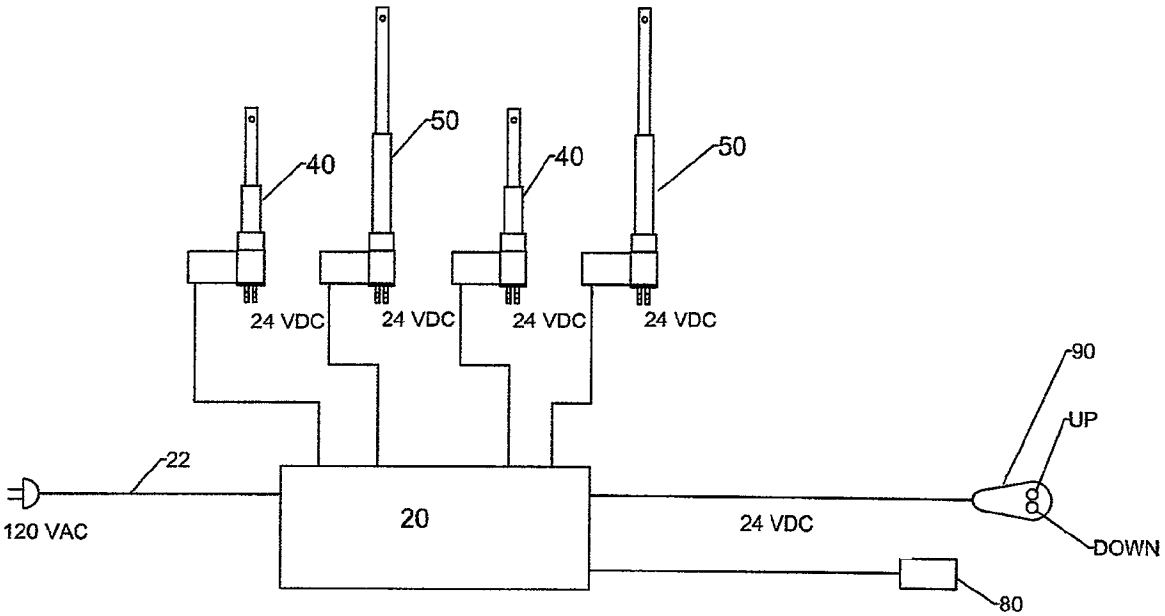
FIG. 6A is an enlarged, simplified version of the schematic of FIG. 6.
Figure 7:
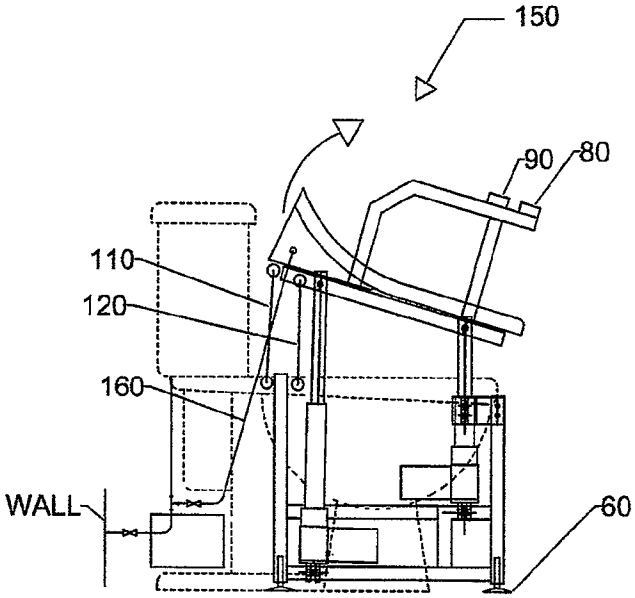

Referring to FIGS. 6 and 6A, there is shown a suitable electrical schematic diagram for operation of the herein disclosed mechanized lift seat with bidet incorporated and attached to a conventional toilet 10. Electrical power is delivered by a power cord 22 which is plugged to UPS 130, a device that allows the mechanized lift seat, with bidet incorporated to keep running for at least a short time if the primary power source is lost. It also provides protection from power surges, in the conventional manner (not shown). The power cord 22 is attached to the power supply 130 inside enclosure 20. Power supply 130 provides power to contactors 140 (FIG. 6) that cause extension or retraction of front 40 and back 50 linear actuators. Switch 80 disables front 40 linear actuators when lift seat assembly 150 is operated in Low Mode. Contactors 140 power hand control 90 to either extend or retract the linear actuators 40 and 50. Thus, in the High Mode, as illustrated in FIGS. 5 and 7, all four linear actuators energize at the same time, whether for up or down motion. By contrast, in Low Mode shown in FIG. 2, only back linear actuators 50 will be energized when seat 100 is forwardly tilted.

FIG. 7 shows a suitable cold water supply connection, indicated at element number 160, to the optional bidet 100. A conventional plumbing T-connector is installed after the existing shut off water valve shut off, such that one leg of the tee continues and is in fluid communication with the water tank 10*a* of the toilet. In the other leg of the T-connector a shut off valve is installed and provided with tubing long enough to allow free movement of the bidet if necessary. With reference to the figure it is clear that a single cold water supply line from the building can provide water to both the toilet tank and to the bidet. If desired, a known heating mechanism can be added to the configuration to provide warm water to the bidet, for user comfort.

FIG. 7 also illustrates the operative position for High Mode, use by a taller person, of the mechanized lift seat 150. In this mode also a bidet device can optionally be attached to a conventional toilet seat 100, such as is commonly found in a private home or institutional environment. During use, when the physiological activities (toilet duties) are complete, the user or an assistant depresses the UP button of the controller 90. In the preferred configuration, when the UP button is depressed and held bidet/toilet seat 100 on upper frame 70 will rise, substantially vertically, straight up, until the UP button is released, or until front linear actuators 40 reach their set point and cause the vertical movement to stop. A useful alternative configuration of the controls 80, 90 can be provided on a corded, or conceivably a wireless hand held device(s) for use by an assistant to the user of assembly 150. Simultaneously, with extending of front actuators 40, back linear actuators 50 will also vertically extend (although further than the front actuators), and cause the rear portion of the seat to slowly move upwardly until the rear actuators reach their set point. The movement of the rear of the seat, to a point higher than the front of the seat causes upward, forward tilting of seat 100, the forward tilting angle being preset to an angle no greater than 35 degrees, thereby assisting the user to get off the seat, by gently and gradually pushing the user upwardly and forwardly.

Figure 8:
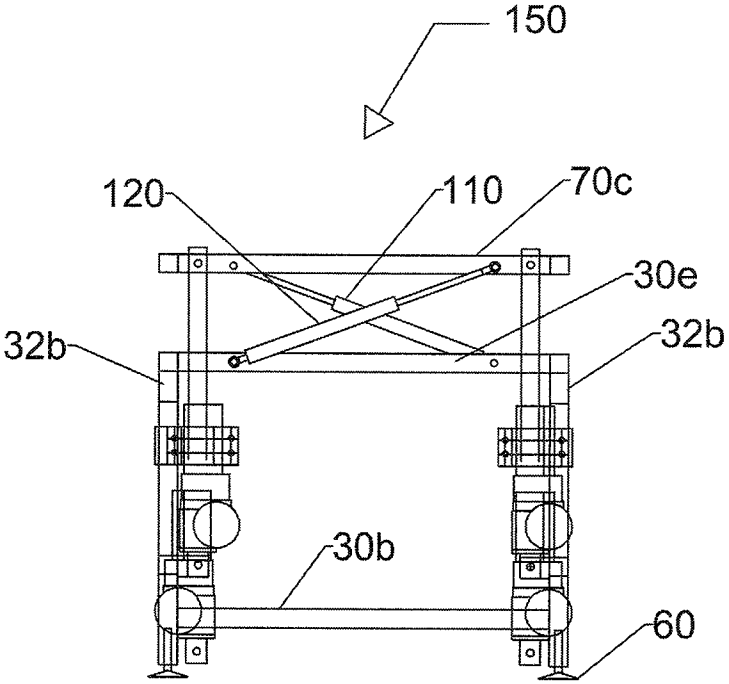
Figure 9:
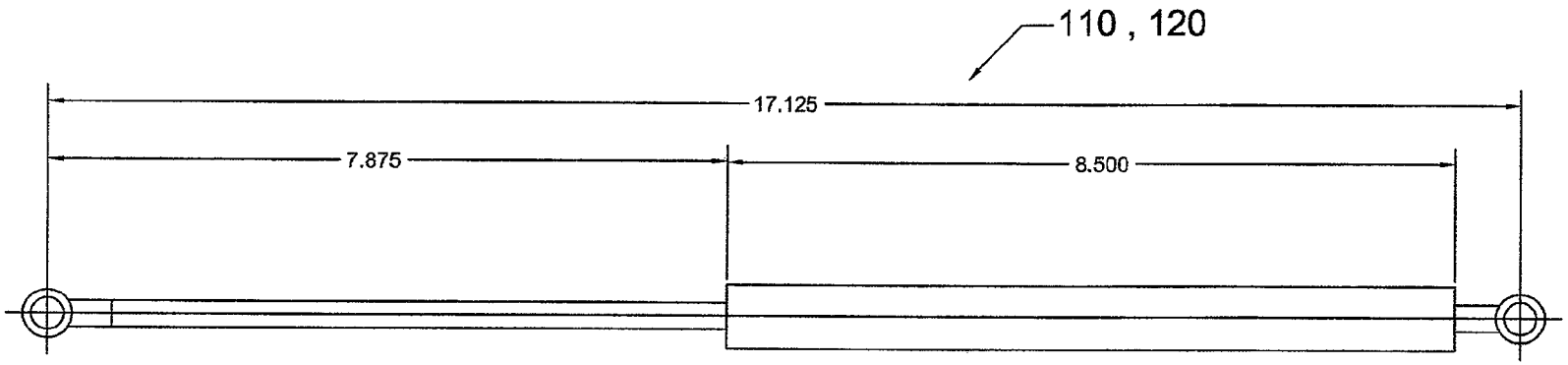

FIGS. 8 and 9 illustrate a further safety feature of the new variable height lift seat 150. In the upper back area of assembly 150 there are two gas springs 110, 120 mounted relative to each other to form an X-shape, so that by operating against each other springs 110, 120 act to stabilize assembly 150, which is especially preferred in high mode and when seat 100 is in its uppermost position, with back linear actuators 50 fully extended. The shaft ends of gas springs 110, 120 are connected to the rear horizontal support bar 70*c* of upper frame 70 and the canister ends of gas springs 110, 120 are connected to a rigid horizontal support bar 30*e*, of lower frame 30, as illustrated in FIG. 8, connecting the upper ends of rear upright supports 32*b*. In this manner the gas springs can move appropriately, with the shafts going in and out as necessary as the upper frame 70 of variable height lift seat assembly 150 moves up and down.

Figure 10:
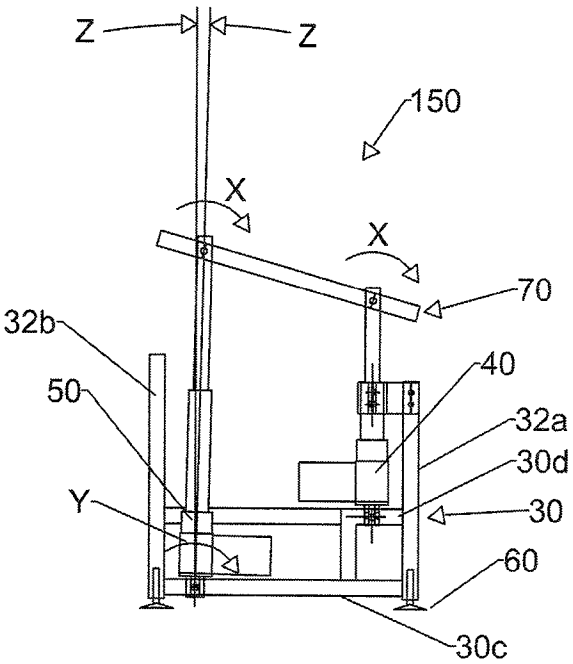

FIG. 10 schematically illustrates the framework of lift seat assembly 150. The arrows actuators 40, 50, which action occurs when rear actuators 50 push the rear portion of the toilet/bidet seat higher than the front portion thereof. The pivotal action, indicated at arrow Y (arrow exaggerated for clarity), is provided at the lower ends of the rear actuators, arrows Z, so that the back part of seat 100 can move sufficiently, under influence from rear actuators 50 to permit the seat to tilt forwardly downwardly from a substantially horizontal plane, and thereby assist a user to more easily dismount the seat.

General Features of the Present Invention

New bidet/toilet seat lift frame (assembly) 150 is easily placed over and around any existing conventional toilet 10, above bowl 10*b*, after removing the existing toilet seat. This feature is possible even with a more recent model (so-called "comfort height") of known toilets that are made for the user to sit higher, by about two inches, than in earlier toilets; i.e., about 18 inches, whereas conventional toilet seat height was about 16 inches. If necessary in such a case, the rigid vertical supports 32*a*, 32*b* from lower frame element 30 can be provided in a longer version. Likewise, an even shorter customized version of the new variable height lift seat could be provided for use by a child or extra small adult.

If the bidet version of variable height seat lift assembly 150 is not chosen, the lift frame can still be used with a bidet-style seat 100, but without the cleansing water feature, or any conventional-style toilet seat can also be used, by merely mounting the seat to the upper lift frame 70*a*, rather than directly to the toilet bowl 10*b* in conventional toilet style. The present toilet seat lift frame assembly 150 can be safely used while not attached to the floor or other support surface, so as to be easily removed for cleaning of the toilet and/or floor. However, the assembly 150 could, if preferred, be securely attached to the support surface, permanently or temporarily, by suitable known mechanisms, such as by bolting, for safety, or to discourage or prevent removal for any reason.

The Up/Down motion of the seat is accomplished by four linear actuators, two at the front of the seat lift assembly 150 and two at the back thereof. When the hand controller up button is depressed for High Mode, all four linear actuators 40,50 will operate; the two front actuators 40 will stop when they reach a preselected set point, and the two back linear actuators 50 will continue traveling upwardly, to stop when they reach their set point, higher than the front set point, so as to tilt the seat somewhat forwardly, but not to such a degree that a seat occupant would be in danger of slipping or falling entirely out of the seat. The preferred angle of forward tilt with these considerations in mind is up to about 35 degrees. An angle as far as 45 degrees would potentially be dangerous to many possible users.

Both front 40 and back 50 linear actuators can be specifically set to meet the height and ability requirements of a given user. The set point of back linear actuators 50 can be set to any safe angle required to assist the handicapped person get off from the toilet seat 100. Both the bidet and non-bidet version of toilet seat lift assembly 150 can have an on/off switch, for example as indicated at 80 on arm rest 180 in FIGS. 1-3, for example, to disable the two front linear actuators. For use in Low Mode; the front linear actuators remain in the low position (disabled) while the back actuators extend upwardly for their respective connections, although they will not move as far upward as they do in use of High Mode. Thus Low Mode is better suited to help a shorter than average person to get up from sitting on the bidet/toilet seat, via gravity and safely, slowly, sliding forwardly. The variable lift seat system 150 is preferably designed to lift up to 500 Kilos/1102 pounds, whether used with the bidet-style seat or with a conventional toilet seat.

FIGS. 1-5 and 7 illustrate new variable height toilet seat lift 150 with at least one arm rest, generally designated 180. Arm rests 180 are preferably connected to upper frame 70 with a substantially horizontal element 180*a* at approximately eight inches above the height of the bidet/toilet seat 100. The overall design of arm rests 180 can conceivably have a somewhat different overall configuration, as compared to the structure illustrated and described herein, for visual and functional comfort of the user. For example, the shape could be altered or the horizontal support 180*a* might have padding, for user comfort. There may also be instances where it is necessary to have the arm rest set at a different height. That can be accomplished via providing an arm rest that is connected to the lift framework in any suitable variable height manner, or by just offering the assembly 150 with an alternate, or customized arm rest height. Further, either one or both of the arm rest structures can be removably connected to the new seat assembly in order to accommodate a patient's particular needs or possible limitations in the installation site. Thus, lift seat assembly 150 can readily be used with only one or no arm rests. The arm rests 180 are designed in shape and strength to assist the person to safely support themselves from the armrests as the assembly moves vertically or tilts. Variations can be provided to accommodate special ergonomic requirements of the individual. The arm rests 180 are preferably fixed or at least very securely, although removably, attached to the assembly upper frame so as to move up or down simultaneously with the up and down motion of the assembly. As shown, the arm rests generally follow the front to back angle of the assembly upper frame as it moves vertically and/or tilts forward or back. While this configuration is preferred, other useful configurations of the arm support can be conceived which can function suitably for user comfort, support, and as a gripping site for user stability.

Another expected variation in the configuration of the new variable height lift seat is that hand controller 90 for vertical movement of the entire bidet/toilet seat and the On/Off switch 80 for the front linear actuators can either or both be located in either arm rest for the use by a right or left handed person. The controls can be attached by flexible cable ties or other devices to arm rests 180, or permitted to remain on the power cord, but only loosely connected to assembly 150, so that an assistant may step away from assembly 150 to provide the user with more privacy.

The optional bidet style toilet seat 100 can be provided with multiple optional features. For example, in addition to personal cleaning and drying features which give the user increased sanitary independence, the bidet style toilet seat can also have a self-cleaning setting so that it will automatically rinse the seat and toilet unit after each use. Moreover, the present invention may be provided with optional accessories, such as, for example, a skirt, which may be of soft fabric or other types of materials that can attached at least around top from 70, if it is desired to disguise or hide the mechanical structures beneath toilet seat 100.

Operation of the Preferred Embodiment

The present invention was designed with ease of operation in mind, to be used by an elderly, blind or otherwise handicapped person with very little training. Installation of the mechanized lift seat 150 is quite easy. First, the preexisting conventional seat of the existing toilet 100 is removed, and the whole assembly 150 is positioned over the existing toilet 100, using the leveling feet 60, if necessary, to ensure that the new seat is substantially horizontal. The installer will then adjust the height of the assembly. If a bidet seat is elected, a plumber can install the cold water line 160 to the bidet, check for leaks, plug the UPS to the ground fault interrupter protected receptacle, and finally plug the power cord of the mechanized bidet assembly power supply and the bidet's power cord to the UPS.

To use the mechanized lift seat assembly with bidet 150 incorporated, for the handicap or elderly person, the user can operate the system either in High Mode or Low Mode, can sit on it flat, as shown in FIG. 1, or the person may choose to first sit on the assembly tilted as shown in FIG. 2, then lower the bidet seat and perform the toilet duties. In either case the user can activate an optional temperature sensor in the bidet seat to warm the seat; and after the toilet duties are performed the person using the bidet controls (not shown) will activate the water flow at the desired water temperature to allow the water to clean the user. When the water flow is stopped an optional air blowing dryer can be started, at the desired temperature, to help the seat lift user get dried. After the drying process the user will depress the UP directional button 90 to lift the back (rear portion) of the bidet seat to assist the user to stand up and get off the seat.

The Up/Down motion of the new seat is accomplished by four telescoping electric linear actuators, two on the front and two on the back of the present seat. The electrical components of the up and down motion, the hand controller, the power supply for the linear actuators and relays are preferably housed in an enclosure such as that available under the name NEMA 4X enclosure, which is placed behind the toilet, under the toilet water tank, as shown in FIGS. 1, 2, and 4. The NEMA 4X enclosure, or an equally suitable substitute, protects the electrical components from being exposed to water in case of a leak, thus eliminating the possibility of a short circuit. If desired, the controls may be of some other suitable type, rather than buttons, for example, a "joy-stick" type control may be substituted at least in part, if more suitable for a given user. Other suitable control types may also be substituted, although the push button version described is preferred.

When hand controller 90 Up-button is depressed, all four linear actuators 40, 50 will operate. Front actuators 40 will stop when they reach the predetermined set point; back actuators 50 will continue traveling upwardly to help the person up from the bidet seat. Back linear actuators 50, such as shown from the side view in FIGS. 1 and 2, will stop moving upwardly when they reach a predetermined set point. This is particularly important in order to prevent possible pinching of a user's fingers, hands, other skin portions or clothing. Both front 40 and back 50 linear actuators of the new seat 150 can be selectively set to meet a user's personal requirements, such as those pertaining to weight and height. The system is designed to lift up to 500 Kilos/1102 pounds.

When the on/off switch is turned to the off position, the front linear actuators 40 are disabled, thus allowing only the back actuators 50 to operate, so that only the rear edge of the toilet/bidet seat 100 will lift, due to upward force from the rear linear actuators 50, helping the person using it to get up more easily from the sitting position. A further safety feature is shown in FIGS. 1 and 2, there is a gap 102 designed to remain between the lower front edge of seat 100 and the front transverse rail 70*b* of upper frame 70. The presence of this gap prevents pinching of the user's flesh, fingers or clothing as seat 100 tilts forwardly.

One example of a suitable bidet seat is commercially available and, has built-in the following usual features: power on/off; remote controller with push buttons for all operating functions; adjustable seat temperature for user comfort; automatic forward and backward movement of the activated spray tube for posterior and front cleaning; adjustable flushing position set up of the bidet spray, for male or female cleansing, and adjustable water pressure and temperature can be set for comfort, with four levels of temperature being a known example.

Other conceivable features of the optional bidet-style seat 100 may include that the bidet nozzle position can be adjusted forward and backwards according user preference; one existing useful embodiment has five positions to adjust. Further, the bidet dryer can blow warm air to dry with adjustable temperature; for example the drying air temperature can be adjusted to four levels of temperature. Other known or as yet undeveloped bidet seats may also function suitably in the presently described and claimed apparatus The foregoing description of specific embodiments of the present invention is for purposes of illustration and description. They are not intended to be exhaustive or to limit the invention to the precise forms disclosed, and many modifications and variations are possible in light of the above teaching. For example, different types of materials may be known or may be later be developed that will be suitable for substitution with those presently described. The embodiments were chosen and descried in order to explain the principles of the invention and its practical applications, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

What is claimed is:

1. A variable height lift seat assembly comprising:

a framework having a front and a back, the framework providing a seat mounting site;

a plurality of linear actuators operably connected vertically to the framework, the linear actuators each having an electrical power supply and preselected set points to provide the assembly with a selectable low mode and a selectable high mode;

a controller operably connected to the linear actuators for separately controlling up and down and angular movement of the seat mounting site of the framework; wherein the framework comprises a lower frame and an upper frame movably connected to the lower frame, the lower frame having a base, the base of the lower frame being disposed at all times substantially horizontally and adjacent to a floor, and the upper frame being at selectively positionable variable heights and forward angles relative to the base of the lower frame, to thereby provide a seat mounting site which is selectively positionable horizontally at variable heights, and which is selectively positionable at a variety of heights at a forward tilting angle relative to the lower frame, as however is suitable for a user of the assembly.

2. The variable height lift seat assembly of claim 1, and further comprising a plurality of rigid upright supports connected at lower ends thereof to the lower frame.

3. The variable height lift seat assembly of claim 2, and further comprising a plurality of rigid horizontal supports connecting at least some of the rigid upright supports to thereby provide strength and stability to the framework.

4. The variable height lift seat assembly of claim 3, wherein the plurality of rigid upright supports includes front rigid upright supports; the variable height lift seat assembly further comprising a plurality of rigid angle members which connect rigid front upright supports to adjacent rigid horizontal supports, each of the rigid angle members providing a site to secure a downwardly directed end of a front linear actuator.

5. The variable height lift seat assembly of claim 1, wherein the electric power supply of each linear actuator is positioned downwardly, within the lower frame of the assembly, and each linear actuator extends vertically upwardly.

6. The variable height lift seat assembly of claim 1, wherein the plurality of linear actuators includes front linear actuators, the front linear actuators being removably fixed to the lower frame and the front of the upper frame being pivotally coupled to the upper ends of the front linear actuators to thereby permit the upper frame to tilt relative to the lower frame.

7. The variable height lift seat assembly of claim 6, wherein the plurality of linear actuators includes rear linear actuators which are longer than the front linear actuators, the lower ends of the rear linear actuators being pivotally coupled to the rear of the lower frame and the rear of the upper frame being pivotally coupled to the upper ends of the rear linear actuators which are longer than the front linear actuators, to thereby permit the upper frame to tilt forwardly relative to the lower frame.

8. The variable height lift seat assembly of claim 7, and further comprising a bracket attaching an upwardly directed end of a rigid upright support at the front of the assembly to a front linear actuator, to thereby provide strength and stability to the front of the framework.

9. The variable height lift seat assembly of claim 7, wherein the upwardly directed ends of both the front linear actuators and the rear linear actuators are pivotally coupled to the upper frame, to thereby permit the upper frame to tilt forwardly when the linear actuators are actuated, as a result of the longer rear linear actuators extending above the height of the front linear actuators when the front linear actuators reach a set point, as well as when the front linear actuators are not activated but the rear linear actuators are activated, to thereby permit selective vertical positioning of the seat mounting site at any one of a plurality of preselected heights, regardless of the angle of the upper frame, and to further permit selective tilting of the seat mounting site of the frame, regardless of the height of the upper frame above the floor.

10. The variable height lift seat assembly of claim 7, wherein the rear linear actuators are pivotally coupled to the lower frame to permit play in the structural position of the upper end of each rear linear actuator as the rear linear actuators are extended to their full length.

11. The variable height lift seat assembly of claim 1, wherein the upper frame has a left side and a right side, and further comprising at least one arm support connected to at least one of the left side and the right side of the upper frame.

12. The variable height lift seat assembly of claim 7, and further comprising an adjustable foot connected at the lowermost end of each of the rigid upright supports, in order to permit leveling of the framework of the variable height lift seat assembly.

13. The variable height lift seat assembly of claim 3, wherein the upper frame (70) includes a right side and a left side formed of rigid members (70*a*) and a rigid horizontal member (70*c*) connecting the right side and the left side at rearwardly extending ends thereof, so that the upper frame (70) is shaped generally as a rectangle open at the front; and further wherein the lower frame (30) includes a right side and a left side formed of rigid horizontal members (30*a,c*) and a rigid horizontal member (30*b*) connecting the right side and the left side at forwardly extending ends of the lower frame, so that the lower frame (30) is shaped generally as a rectangle open at the rear; a vertical rigid support (32*b*) extends upwardly from rearwardly directed ends of each of the horizontal rigid bars (30*a,c*) on the right side and the left side of the lower frame (30) and a further rigid horizontal support (30*e*) is fixed at opposed ends thereof to the upper ends of the rigid vertical supports (32*b*) at the rear of the lower frame (30), to thereby provide a frame for the assembly which permits placement of the lower frame (30) around the base of a toilet and permits user access to the interior of the assembly via the front of the upper frame (70).

14. The variable height lift seat assembly of claim 13, and further comprising a pair of gas springs (110, 120) connected to the framework in an X-formation in relation to each other, with the piston ends of the gas springs connected to the rigid rear horizontal support (70*c*) of the upper frame (70) and the cylinder ends of the gas springs (110,120) connected to the rear rigid horizontal support (30*e*) of the lower frame, to thereby provide strength and structural support to the framework of the variable height lift seat assembly, especially when the linear actuators (40, 50) are extending and contracting.

15. The variable height lift seat assembly of claim 1, wherein the electric controls include an up/down function to operate the linear lift actuators up or down as required, thereby lifting or lowering the lift seat to a selected height.

16. The variable height lift seat assembly of claim 15, wherein the electric controls include an on/off switch that can be selectively positioned on an arm support on either the user's right side or left side of the framework when the user is seated on the lift seat, to permit either a left-handed user or a right-handed user to operate the electric controls.

17. The variable height lift seat assembly of claim 6, wherein in the electric controls comprise a switch to disable the front linear actuators when the lift seat is being used by a short person.

18. The variable height lift seat assembly of claim 1, wherein the plurality of linear actuators comprises four electric linear actuators providing the force to lift or lower the seat mounting site, with one linear lift actuator being connected to the upper frame and the lower frame via the corresponding upper and lower ends of each linear actuator, substantially adjacent to each corner of four corners of the framework.

19. The variable height lift seat assembly of claim 1, wherein the framework has dimensions which accommodate the placement of the framework around the front, sides and upper extent of a toilet bowl.

20. The variable height lift seat assembly of claim 1, wherein the degree of forward tilt of the lift seat is no greater than 35 degrees.

21. The combination of a seat and variable height lift seat assembly, wherein the variable height lift seat assembly comprises a framework having a front and a back, the framework providing a seat mounting site;

a plurality of linear actuators (40, 50) vertically operably connected to the framework, the linear actuators each having an electrical; power supply (130) and preselected set points to provide the assembly with a selectable low mode and a selectable high mode;

an electric controller (90) operably connected to the linear actuators for electrically separately controlling up and down and angular movement of the upper frame; and a seat (100) mounted on a seat mounting site of the upper frame.

22. The combination of claim 21, wherein the seat is a toilet seat mounted on the upper frame.

23. The combination of claim 21, and further wherein the toilet seat is a bidet-style seat mounted on the upper frame.

24. The variable height lift seat of claim 23, wherein the electric power supply and all controls to operate the bidet lift seat are mounted inside of a water proof enclosure to protect all the components from getting wet and having a short circuit.

25. The variable height lift seat of claim 24, and further comprising a power cord connected to the electrical controls and mounted on the water proof enclosure.

26. A variable height lift bidet seat comprising:

a framework, a plurality of linear lift actuators connected to the framework and vertically movably disposed within the framework, a bidet seat forwardly, tiltably mounted on the framework, an electrical controller (90) connected to the linear lift actuators and having electric controls sufficient to permit a user of the seat to selectively move the seat vertically up and down regardless of the angle of the seat, and to selectively tilt the seat forwardly at a rate and to an angle no greater than 35 degrees, regardless of the height of the seat, to facilitate movement of the user off of the lift bidet seat and to a standing position without significant risk of causing the user to slide or fall forwardly off of the bidet seat.

27. The variable height lift seat assembly of claim 26, and further comprising gas springs (110, 120) connected to the back (30*e*, 70*c*) of the framework in an X formation, to absorb shock and thereby enhance the stability of the lift seat assembly to improve the safety and comfort of a user for the assembly.

28. A horizontally and angularly variable height lift seat assembly comprising:

an open framework having a front and a back, the open framework providing a seat mounting site;

a plurality of linear actuators vertically operably connected to the open framework, the linear actuators each having a power supply and preselected set points;

a controller operably connected to the linear actuators for separately controlling up and down and angular movement of the seat mounting site of the framework;

wherein the framework comprises a lower frame and an upper frame movably connected to the lower frame, the lower frame having a base, the base of the lower frame being disposed at all times substantially horizontally and adjacent to a floor, and the upper frame being disposed at a variable selectable height and being either substantially parallel to the base of the lower frame or at a forward tilting angle relative to the lower frame, the forward tilting angle being preset to an angle no greater than 35 degrees;

four rigid upright supports connected at lower ends thereof to the lower frame;

a plurality of rigid horizontal supports connecting at least some of the four rigid upright supports to thereby provide strength and stability to the framework, the four rigid upright supports including two front rigid upright supports and a pair of rigid angle members which connect the two rigid front upright supports to adjacent rigid horizontal supports, each of the two rigid angle members providing a site to secure a downwardly direct end of a front linear actuator, the power supply of each of the two linear actuators being positioned downwardly, within the lower frame of the assembly, and each of the two linear actuators extending vertically upwardly, the two front linear actuators being removably fixed to the front lower frame and pivotally coupled to the front upper frame;

a pair of rear linear actuators which are longer than the front linear actuators, the rear linear actuators being pivotally coupled to the base of the lower frame, one each on right and left sides of the frame and pivotally coupled to the upper frame, to thereby permit the upper frame to tilt forwardly when the rear linear actuators are actuated, as a result of the longer rear linear actuators extending above the height of the front linear actuators when the front linear actuators reach a set point, as well as when the front linear actuators are not activated but the rear linear actuators are activated, to thereby permit selective vertical positioning of the seat mounting site at any one of a plurality of preselected heights, and to further permit selective tilting of the seat mounting site of the upper frame regardless of the height of the seat mounting site, but only to the maximum preset angle;

wherein the rear linear actuators are pivotally coupled to the lower frame in such manner as to permit play in the structural position of the upper end of each rear linear actuator as the rear linear actuators are extended to their full length;

wherein the upper frame includes a right side and a left side and a rigid horizontal member connects the right side and the left side at rearwardly extending ends thereof; and further wherein the lower frame includes a right side and a left side and a rigid vertical support extends upwardly from rearwardly directed ends of each of the right side and the left side of the lower frame and a further rigid horizontal support is fixed at opposed ends thereof to the upper ends of the rigid vertical supports so connected at the rear of the lower frame; and a pair of gas, springs connected to the framework in an X-formation in relation to each other, with the piston ends of the gas springs connected to the rigid rear horizontal supports of the upper frame and the cylinder ends of the gas springs connected to the rear rigid horizontal supports of the lower frame, to absorb shock and thereby enhance the stability and user comfort of the variable height lift seat assembly, especially when the linear actuators are extending and contracting.

* * * * *